US007156193B2

(12) United States Patent
Swartout

(10) Patent No.: US 7,156,193 B2
(45) Date of Patent: Jan. 2, 2007

(54) CONTINUOUS POSITIVE FLOW BACKFLASH PREVENTION SYSTEM

(76) Inventor: Matt Swartout, 1131 Varsity Estate Rise N.W., Calgary, Alberta (CA) T2P 0S5

( * ) Notice: Subject to any disclaimer, the term of this patent is extended or adjusted under 35 U.S.C. 154(b) by 323 days.

(21) Appl. No.: 10/860,097

(22) Filed: Jun. 4, 2004

(65) Prior Publication Data

US 2005/0269135 A1 Dec. 8, 2005

(51) Int. Cl.
*E21B 21/06* (2006.01)
*F23D 14/82* (2006.01)

(52) U.S. Cl. ..... 175/66; 175/209; 431/346

(58) Field of Classification Search ..... None
See application file for complete search history.

(56) References Cited

U.S. PATENT DOCUMENTS 3,463,227 A 8/1969 Smith
3,990,835 A * 11/1976 Burton, III ..... 431/353
4,865,820 A 9/1989 Dunster et al.
4,872,949 A * 10/1989 Wilwerding ..... 159/47.3
4,909,730 A 3/1990 Roussakis et al.

* cited by examiner

*Primary Examiner*—Zakiya W. Bates
(74) *Attorney, Agent, or Firm*—Sean W Goodwin; Linda M Thompson

(57) ABSTRACT

A method and system for the prevention of backflash from an ignition source in a flare stack to a separator or wellbore particularly during drilling and production. A continuous positive flow of air or exhaust gas is provided into the flow of gases from the wellbore or the separator to ensure that the velocity of the flow is always higher than the velocity at which the flame can propagate backwards into either the separator or the wellbore. This method and system is particularly applicable to balanced, underbalanced and air drilling operations where the flow of gas from the wellbore is intermittent and unpredictable and can stop and start during connection and disconnection of the air used as the drilling fluid.

27 Claims, 5 Drawing Sheets

CONTINUOUS POSITIVE FLOW BACKFLASH PREVENTION SYSTEM

FIELD OF THE INVENTION

Embodiments of the invention relate to systems for preventing backflash from a flame source and, more particularly, to the prevention of backflash from a flame used to burn at least a portion of combustible gases from a wellbore, either directly or following separation in a separator.

BACKGROUND OF THE INVENTION

In the drilling of oil and gas wells and in oil and gas production facilities, flare stacks and/or blooie lines are used, through which combustible gases, offgassed from the wellbore, are released and burned. The release of gas through the flare stack or blooie line is typically intermittent and has non-predictable rates, including low velocity flow, creating the potential for backflash, which is the advancing of the flame front back through the flow to the source of the gas.

During the drilling of oil and gas wells, using a variety of drilling fluids including, but not limited to air, mist, foam, aerated and liquid mud systems, the release of combustible gases is most likely to occur while drilling at balanced or underbalanced phases of well control. Air drilling operations, whether straight air, mist or foam, are particularly at risk for backflash and, particularly so, when stopping and starting the flow of air to the wellbore while making drillpipe connections. After connection and following commencement of the flow of air in the drillpipe, it takes some time before the air completes the circuit downhole and back to surface, thus leaving a lower gas velocity below the flare igniter and therefore creating the potential for backflash.

Generally, backflash is most likely to occur where there is a combination of three factors, namely; a low to zero velocity flow of a combustible air and hydrocarbon gas mixture through the flare stack or blooie line; the combustible gas mixture is contained in a finite structure within the flare stack and/or blooie line or other structure; and there is a means for igniting the combustible gas mixture. One such typical example exists in a flare stack line extending from a separator vessel or a blooie line extending from the wellhead in underbalanced or balanced drilling wherein a combustible gas mixture flows from the wellbore flow tee, diverter or rotating diverter head or the separator to the flare stack and/or blooie line having an outlet to the atmosphere, the flare stack and/or blooie line being equipped with a continuous ignition source.

As described in "Flammability and Flashback Prevention (a work in progress)" by Dan Banks, P.E posted on the worldwide web at www.banksengineering.com/about flame arrestors and detona.htm, flame progresses at a defined rate through a combustible mixture. If the flow velocity of the gas mixture through the flare stack and/or blooie line falls below a minimum gas velocity, the minimum gas velocity being a velocity greater than a flame propagation velocity, the flame is capable of moving upstream from the point of ignition to the source of the gas and igniting the gas therein. For example, in the case of a methane/air mixture, the velocity in the pipe must exceed 1.5 ft/sec to prevent flame propagation upstream to the ignition source. If the gas source of the combustible mixture is at the separator, the separator is at risk of explosion; or if the flame front of the backflash travels down into the wellbore, a downhole fire and possibly an explosion is likely, which could result in the loss of the entire well section.

Typically, conventional underbalanced separators utilize backpressure valves during balanced and underbalanced drilling operations to attempt to prevent backflash however, in some circumstances the backflash can still occur through the backpressure valve. Further, pressure maintained in the separator as a result of the backpressure valve retards entrained gas from evolving from the drilling fluids in the separator. As drilling fluids are passed to a shale shaker, entrained gas which did not evolve in the separator can evolve at the shaker, creating a fire potential or the potential for the release of carcinogenic and toxic gases. The backpressure valve may also result in the exertion of a higher bottom hole pressure on the formation which can interfere underbalanced drilling. In the case of blooie line systems, it is typical that no backflash systems are employed. In either case, it is known in the industry that backflashes to separator vessels and into wellbores have occurred, resulting in compromise to the structural integrity of mud/gas separators and causing underground fires. In Canada, backflashes have been experienced by a number of companies, particularly while air hammer drilling and/or foam drilling.

As reported by Susan Eaton in New Technology Magazine, March 2002 "Conquering Foothills Challenges—the air force", air drilling can be dangerous, risky and costly, and underground fires are a real danger. As suggested, successes have been realized using a combination of air and nitrogen or nitrogen alone to replace combustible mixtures with air, however providing a source of compressed nitrogen suitable for use in the volumes required for air drilling is costly and requires additional specialized equipment at surface.

Flame arrestors are known in the industry. Known flame arrestors typically either quench flame by reducing the velocity of the flame, stop flame propagation, pass the gas mixture through a water chamber or heat sink to dissipate heat and reduce potential for ignition, block the fuel gas path with a thermal fuse plug causing the backflash to die out, or block the flow of fuel gas using a quick-acting non-return valve. Flame arrestors have been known to plug up and/or freeze as a result of cuttings and/or wet gas.

Venturi-type arrestors are used to create a restriction in the delivery of the gas mixture and therefore increase the velocity of the gas to be greater than the flame velocity. In cases where gas flow decreases or stops, venturi-type arrestors are no longer effective. Typically, flow through the gas delivery system is monitored and makeup gas is added only when the flow of the gas drops below a critical level.

Inline flame arrestors are also known. Arrestors of this type are typically heat-sink type arrestors filled with metal, ceramic or fluid and act to absorb heat from a flashback to quench the temperature below ignition temperatures. Fluid-type arrestors are prone to freezing when used in low ambient temperatures and therefore are not functional in many drilling applications.

In cases where a large influx of fluids or gas, called a "kick", is encountered or predicted while drilling, the operator typically shuts the blowout preventer (BOP), weights up the drilling fluid and commences drilling again using a heavier drilling fluid to increase the hydrostatic head in the wellbore which is capable of suppressing or minimizing the fluid influx. Cessation of drilling and weighting up the drilling fluid results in lost drilling time and decreased rates of penetration (ROP).

Clearly what is needed is a simple, reliable backflash flame arresting system that can be employed in a number of flaring applications and, more particularly, to flaring operations where the flow of combustible gas to the flare may be intermittent and unpredictable, such as in air drilling. Further, it is desirable that the system permit continued drilling despite the intermittent influx of combustible hydrocarbons so as to maintain high ROP's.

SUMMARY OF THE INVENTION

A method and system for prevention of backflash from an ignition source to a source of combustible gas utilizes a flow of addition fluid, typically air or exhaust gas, introduced into the flow of combustible gas to the ignition source in at least a minimum flame propagation velocity to ensure a continuous positive flow to the ignition source regardless the intermittent and unpredictable nature of the flow of combustible gas. Embodiments of the invention are particularly useful when drilling wellbores in balanced and underbalanced conditions and more particularly, using air/foam/aeration drilling.

In a broad aspect of the invention, a method for prevention of flashback from an ignition source towards a wellbore during drilling of the wellbore comprises injecting a drilling fluid into a wellbore; producing the drilling fluid from the wellbore for removing cuttings from the wellbore, the produced drilling fluid containing combustible gas; flowing the combustible gas to the ignition source for burning of said combustible gas; and continuously providing an addition fluid at a velocity of at least a minimal flame propagation velocity into the flowing combustible gas downstream of the wellbore and upstream of the ignition source for avoiding flashback from the ignition source.

In a further broad aspect of the invention, a system for the prevention of flashback from an ignition source connected to a wellbore producing unpredictable and intermittent flows of combustible hydrocarbons during drilling of the wellbore, comprises a source of addition fluid connected to the flow of combustible hydrocarbons between the wellbore and the ignition source; a venturi for accelerating the flow of the addition fluid into the flow of combustible gas for inducing flow of combustible gas to the ignition source; wherein the addition fluid is continuously provided to the flow of combustible hydrocarbons in a velocity in excess of a minimal flame propagation velocity to prevent backflash from the ignition source to the wellbore.

The addition fluid is typically air or exhaust gas and in an embodiment of the invention, is provided into the flow between the wellbore and the ignition source using a venturi, which acts to accelerate the flow of the addition fluid causing the combined flow to be accelerated and ensures the combustible gases flows towards the ignition source. The venturi inlet can be positioned anywhere between the wellbore and the ignition source, typically a flare stack or blooie line.

In an embodiment of the invention, the venturi is positioned between a separator and the flare stack, the separator acting to provide containment of the off-gas produced with the drilling fluids and cuttings from the wellbore and to direct the gas evolved from the drilling fluids to the flare stack. The use of the separator in combination with the positive flow achieved by the addition fluid, enables drilling to proceed regardless whether "kicks" of combustible gas come from the wellbore, eliminating the need to shut the BOP's and weight up or otherwise change the drilling fluids and reducing the fear of backflash, while at the same time providing containment of gases within the separator for evolution therein and release to the flare stack without fear of gases remaining entrained and releasing at the shale shaker. The ability to drill without altering the hydrostatic head in the wellbore permits balanced and underbalanced drilling to continue and further results in being able to maintain higher ROP's.

In the case where there is a potential for the release of sour gas from the wellbore, a vacuum degasser is introduced after the separator and discharges gas to the flare stack and liquid to the shale shaker. Liquids exiting the separator are passed to the vacuum degasser to ensure that any gas remaining in the liquid is evolved from the liquid, the evolved gas being flowed to the flare stack and the liquids and solids directed to the shale shaker.

Often drillers overlook the advantages of air drilling due to the time and costs associated with rig up and rig out of conventional air equipment implementation. A further advantage of the system of the present invention is that the system can be installed at the start of well drilling and can be used for all drilling fluid programs which might be employed, including conventional overbalanced, balanced, underbalanced and air drilling and transitions therebetween. Further, implementation of the system of the present invention minimizes drilling interruptions with changes of drilling fluids.

DETAILED DESCRIPTION OF THE PREFERRED EMBODIMENT

Figure 1:
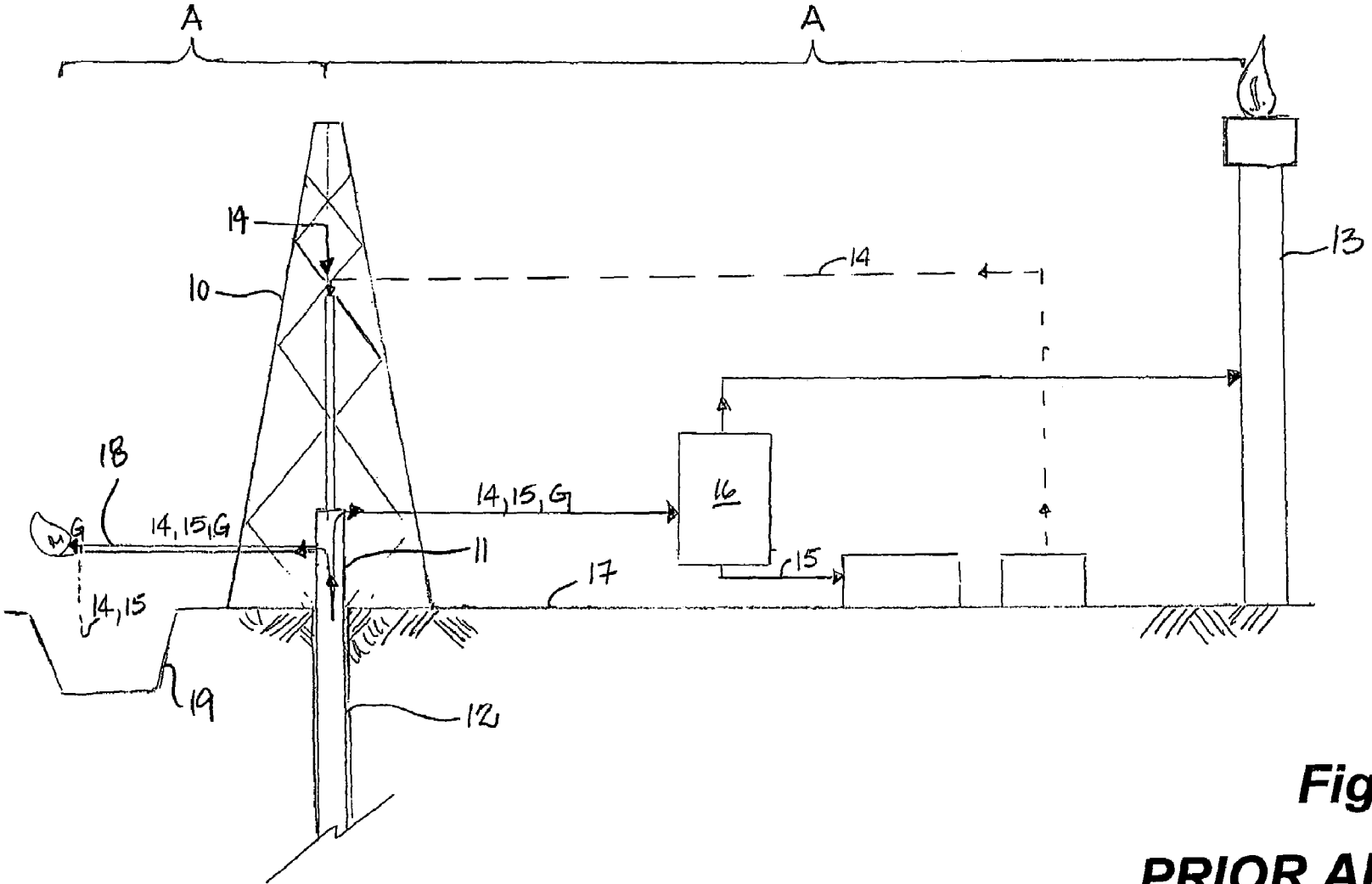
Fig. 1 PRIOR ART
FIG. 1 is a schematic of a typical mud drilling operation, being an air, mist, foam aerated mud or liquid mud drilling operation, illustrating a conventional wellsite configuration from a wellhead through to a flare or alternatively to a blooie line, a dotted line indicates recycling of drilling mud to the wellbore in the case of a mud drilling operation.

With reference to FIG. 1, a conventional drilling system comprises a drilling rig 10, a wellhead 11, wellbore 12 and a flare 13. Drilling fluids 14 are injected into the wellbore 12 to aid in extraction of cuttings 15 with the drilling fluids 14 from the wellbore 12. Suitable drilling fluids 14 include air, mist, foam or aerated mud or non-compressible liquid drilling fluids. The cuttings 15 are separated 16 from the drilling fluids 14 at surface 17. In the case where aerated mud or non-compressible mud is, the drilling fluid 14 is typically recirculated to the wellbore 12, following separation 16 of the cuttings 15. In air, mist or foam drilling, air is used to extract cuttings from the wellbore 12, in place of drilling mud. The cuttings 15 may be lifted as dust or mist should there be an influx of water into the wellbore 12. Further, agents may be added to the wellbore 12 during drilling to create a foam to aid in lifting the cuttings 15. Drilling fluids 14 returning to surface 17 often include wellbore gases G including combustible hydrocarbons or off-gas which is burned at the flare 13 or alternatively, directly from a blooie line 18, which is typically used to discharge returned drilling fluids 14 to a flare pit 19. The rate of production of off-gases is highly unpredictable and typically intermittent.

Figure 2:
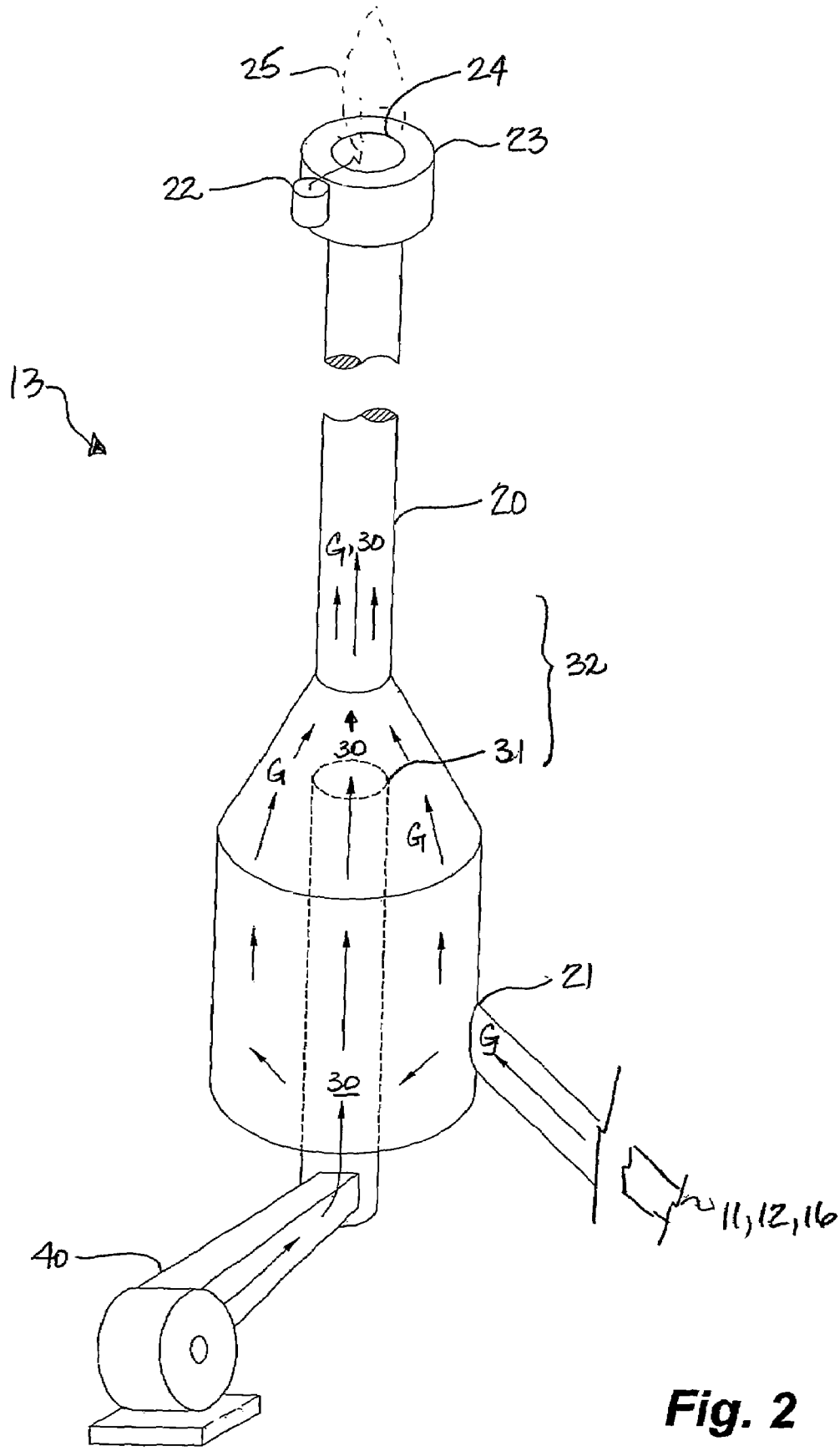
FIG. 2 is a schematic of an embodiment of a flare for use in an embodiment of the invention in a wellsite configuration according to FIG. 1.

Having reference to FIG. 2, an embodiment of a flare 13 safely used in flaring wellbore off-gas comprises a flare stack 20 having an inlet 21 for receiving a flow of wellbore gas G. An ignition source 22 is positioned within an upper end 23 of the flare stack 20 or adjacent an outlet 24. The ignition source 22 is typically continuous, providing a flame 25 for combusting the combustible wellbore off-gases, and discharging products of said combustion through the outlet 24 to atmosphere.

Figure 3:
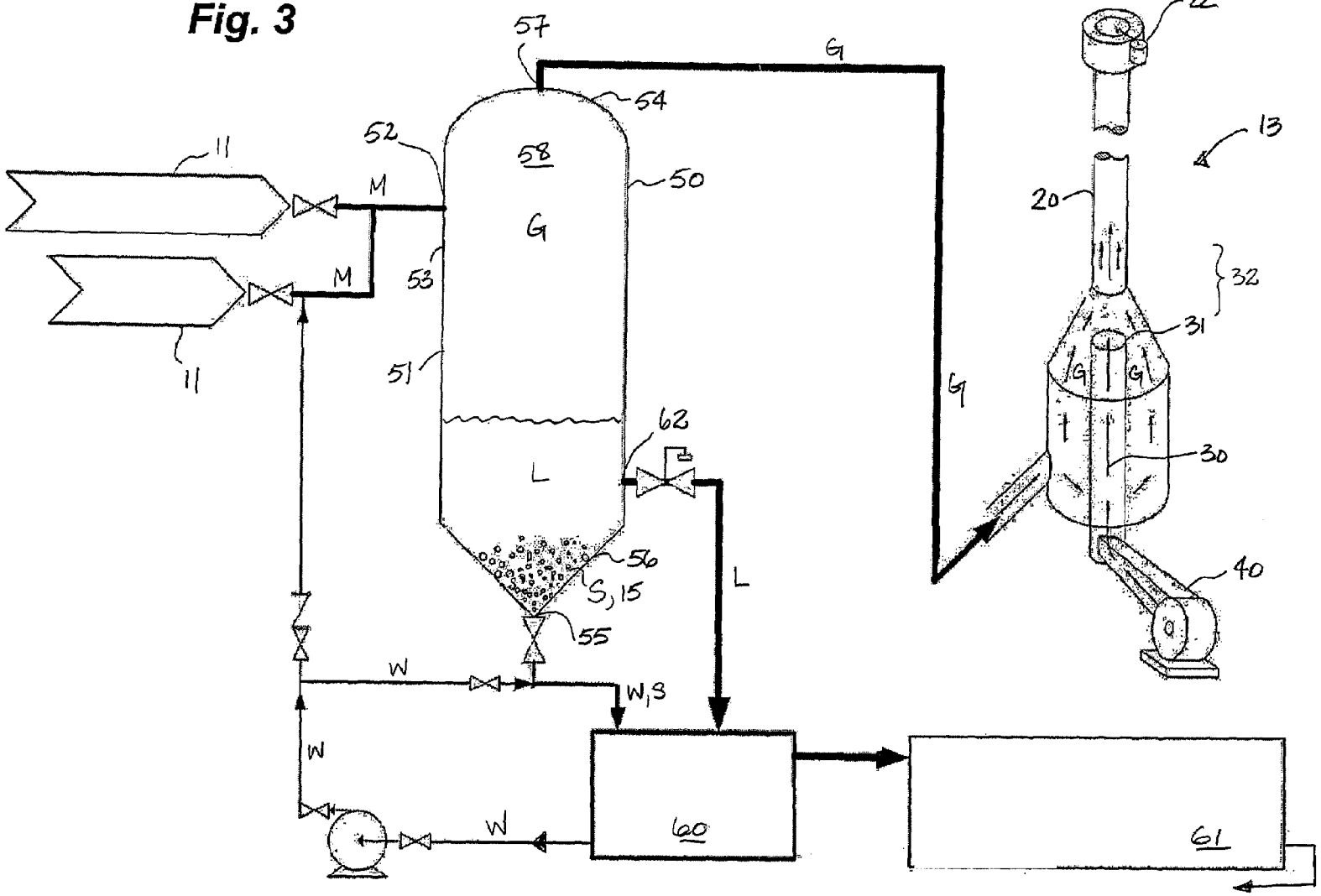
FIG. 3 is a schematic illustrating an embodiment of the invention being a system for backflash prevention used in a drilling application and incorporating a flare according to FIG. 2, the particular embodiment illustrated being an air drilling operation using air, mist or foam as a drilling fluid, the system however being applicable to all mud drilling systems.

In one embodiment of the invention, a continuous source of addition fluid 30, typically air or exhaust gas, is introduced to the flow of off-gases G from the wellhead 11 at a constant velocity equal to or in excess of a minimum flame propagation velocity. The minimum flame propagation velocity is that velocity at which the flame is prevented from traveling upstream through the flow of gases. As shown in FIGS. 1 and 3, the addition fluid 30 may be added at any point A in the flow stream downstream of the wellhead 11, and upstream of the ignition source 22.

Figure 4:
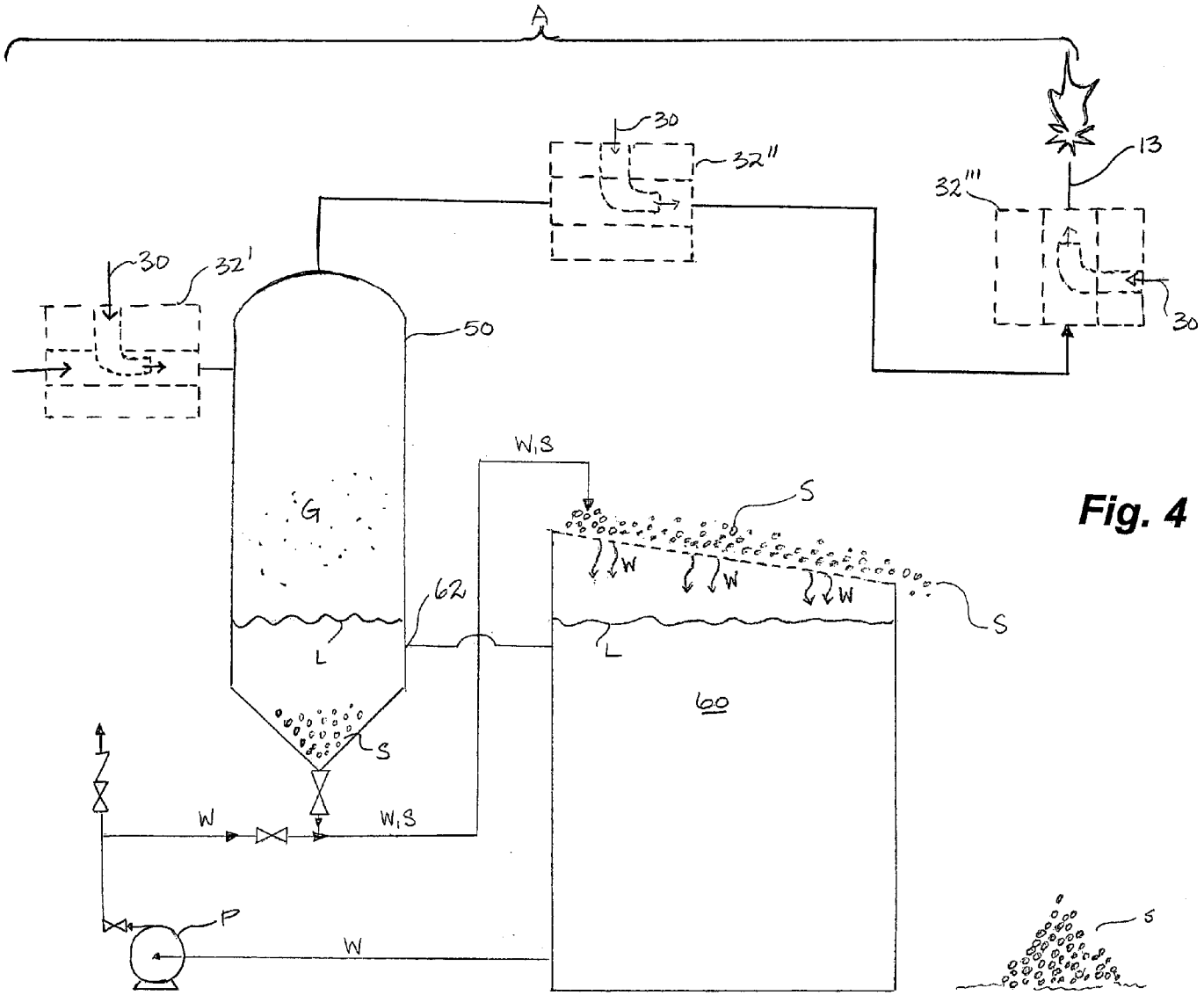
FIG. 4 is a schematic illustrating alternate venturi positioning and recirculating of fluid from a shale shaker tank past a solids outlet at a bottom of a separator for moving solids from the separator to the shale shaker.

Further, in an embodiment shown in FIGS. 2–4, the addition fluid 30 is introduced through an addition fluid inlet 31, such as a venturi 32. The venturi 32 may comprise an arrangement wherein the addition gas inlet 31 is located co-axially in the flow stream. The addition fluid 30 is discharged at a velocity higher than the velocity of the wellbore off-gas G and thereby accelerates the wellbore off-gas. Wellbore off-gas is drawn around the addition fluid inlet 31 and into the flow of addition fluid 30 for directing the combined fluid or mixture F to the ignition source 22.

In one embodiment, shown in FIG. 2, the addition fluid 30 is introduced into flare stack-20 upstream from the ignition source 22. An air blower, helical screw or reciprocating compressor 40 or the like, may be used to supply the addition fluid 30 flow to the addition inlet 31. In the case of a methane/air mixture, the minimum flame propagation velocity is approximately 1.5 ft/s and therefore, the addition fluid 30 must be provided at 1.5 ft/s or greater so that, should there be no flow from the wellbore 12, the minimum critical velocity is met and the flame 25 will remain at the ignition source 22 and not propagate upstream towards the wellbore 12 or separator 16. In addition to providing a continuous positive flow of gases from the wellbore 12 to the flare 13 and preventing a backwards propagation of the flame 25 to the wellbore 12, the venturi 32 creates a suction which can act to draw the produced wellbore off-gases G away from the wellhead 11 and any associated equipment and processes, further increasing the safety of personnel working on site. This may be particularly advantageous in the case of produced sour gas, which if accidentally vented, may present increased hazards to the environment and to personnel on site.

The system, while particularly applicable where drilling is planned to be operated under balanced and underbalanced conditions, is also applicable to overbalanced drilling which may become balanced or underbalanced either by choice during drilling or as a result of problems encountered in the well.

Figure 5:
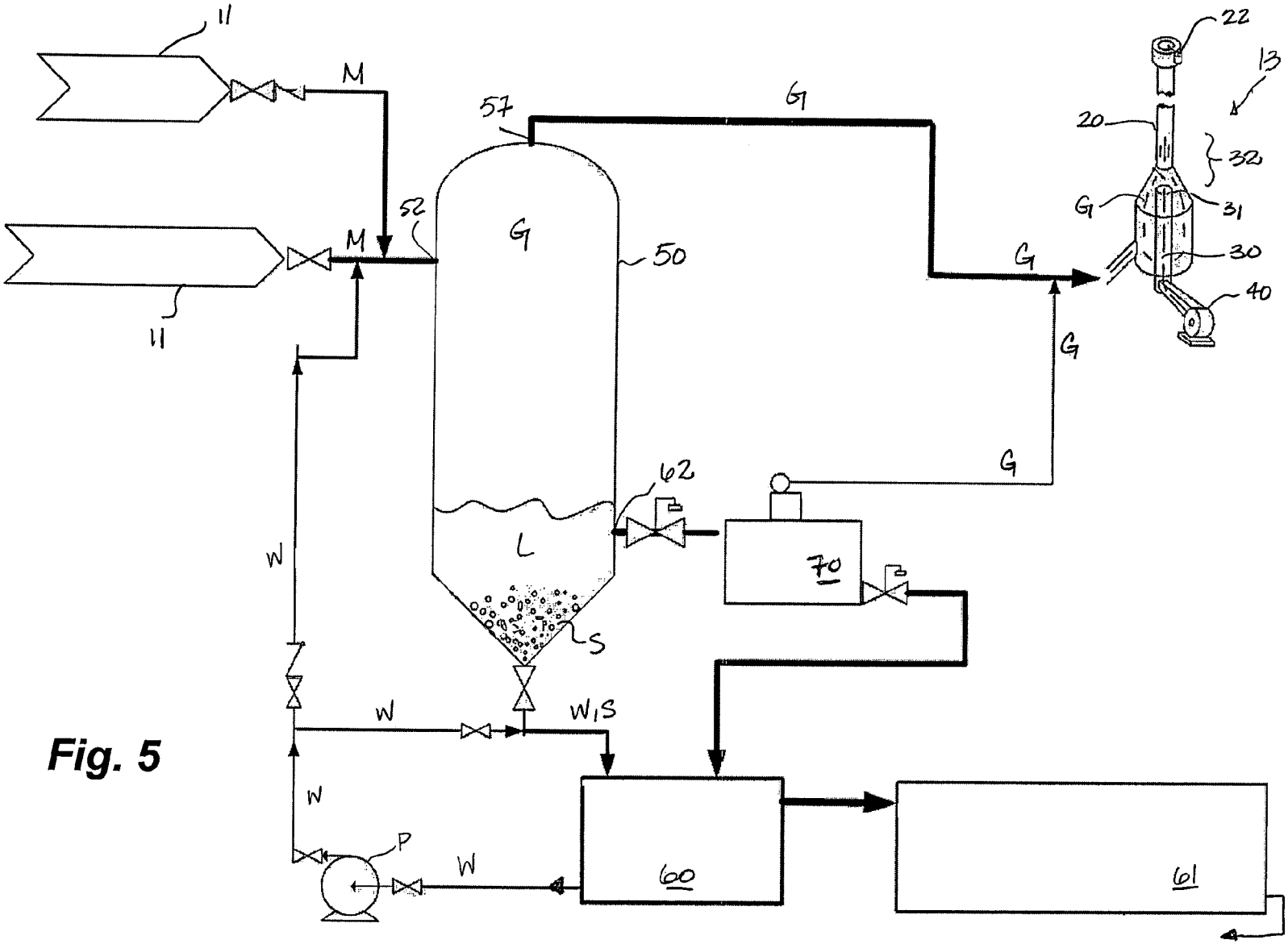
FIG. 5 is a schematic illustrating an embodiment of the invention having a vacuum degasser and being particularly applicable for drilling operations wherein the off-gas from the wellbore may contain at least a portion being sour gas.

Having reference to FIGS. 3–5, the flare stack 20 and continuous positive air/gas flow system of the present invention is incorporated into an overall system for prevention of backflash in a drilling operation and, more particularly, in an air drilling operation having a three-phase separator 50 for separating gases from liquids and cuttings produced from the wellbore 12. The separator 50 is typically positioned between the wellhead 11 and the flare stack 20 and, in conventional air drilling operations, is at risk for structural damage as a result of explosions caused by backflash from the flare 20. As shown in FIG. 4, locating an addition fluid 30 and venturi 32 at some point A, 32', 32", 32'" and more preferably as an embodiment 32", 32'" between the separator 50 and flare stack ignition source 22 acts both to ensure that backflash to the separator 50 does not occur and further, due to the induction of wellbore off-gases G, acts to minimize separator pressure to further effect gas liberation from liquids therein.

More particularly, and in a preferred embodiment of the invention, the separator 50 for use in the present system is configured as a vertical separator, adapted for use in mud drilling systems and aerated mud systems, as well as air, mist and foam drilling systems. The separator 50 comprises a tubular, closed body 51 having an inlet 52 formed in a sidewall 53 of the separator 50 adjacent a top end 54 of the separator 50 for receiving a stream of fluids M comprising gases G, liquids L and cuttings 15 from the wellbore 12. A solids outlet 55 is formed at a bottom 56 for directing solids S, particularly cuttings 15, out of the separator 50 and a gas outlet 57 is formed at the top 54 of the separator 50 for discharging wellbore off-gases G.

Preferably, the bottom 56 is conical and angled at 33° or greater to ensure that solids S, which are gravity separated from liquids L and gases G therein, do not become trapped in the separator's bottom 56 and are instead directed for discharge from the solids outlet 55.

Gases G, released from the liquids L and solids S, are contained within a headspace 58 above the liquids L in the separator 50 and are directed from the gas outlet 57 to the flare stack 20.

As shown in FIG. 3 and, in greater detail, in FIG. 4, largely dewatered solids S, separated from the returned drilling fluids 14 and discharged from the solids outlet 55 at the bottom 56 of the separator 50 are directed to a shale shaker 60 where the solids S can be readily sampled. A level of liquid L in the separator is hydraulically kept constant with a liquid level L in the shale shaker tank 60 resulting in a stagnant sump and causing the solids S to drop from the bottom 56 of the separator 50. Due to the significant volume of liquid L relative to the solids S in the conical portion of the separator 50, the residence time within the separator 50 is relatively long, maximizing any gas G evolution therefrom and into the head space 58. Further, the liquid L forms a liquid barrier preventing gas from venting to the shale shaker tank 60.

Preferably, as shown in FIG. 4, to aid in the discharge of solids S from the solids outlet 55, screened fluids W are pumped P, from the shale shaker tank 60 or alternately from a mud tank or spare tank 61, past the solids outlet 55 where the fluids W combine with the solids S to carry the solids S onto the shale shaker 60. The fluids W are largely solids free and are continuously re-circulated by the pump P. As there is little remaining solid S in the fluid W following screening on the shale shaker 60, it is not required that the pump P be a solids pump.

A large portion of the liquids L separated in the separator 50 are routed to the shale shaker 60 from a liquid outlet 62 positioned in the sidewall 53 of the separator 50.

Advantageously, the vertical separator 50 has a smaller footprint than conventional horizontal separators used in underbalanced drilling and thus requires less space at the wellsite. Depending upon the intended use requirements and reservoir conditions, the separator 50 may or may not be pressure rated. Further, the system reduces the number of personnel required to operate the site.

As shown in an embodiment in FIG. 5, and for more complete degassing especially for use where the off-gases G produced from the wellbore 12 may contain at least some $H_2S$ or sour gases, a vacuum degasser 70 is connected to the system at the liquid outlet 62 for increased removal of off-gases G from the drilling fluids 14. Liquid L transported via the liquid outlet 62 to the vacuum degasser 70 are largely solids-free to avoid plugging of the vacuum degasser 70. Gas G entrained within the liquid L is removed by the vacuum degasser 70 by differential gas liberation in accordance with conventional technology. The separated gas G is then routed to the flare stack 20 for flaring.

The addition fluid 30 is introduced downstream of the vacuum degasser 70 and adds further to the safety of the system ensuring that a continuous ignition source 22, provided for flaring of hazardous sour gas, can be maintained without fear of backflash, regardless the intermittent or unpredictable production of said hazardous off-gas G.

The embodiments of the invention in which an exclusive property or privilege is claimed are defined as follows:

1. A method for prevention of flashback from an ignition source towards a wellbore during drilling of the wellbore comprising:

injecting a drilling fluid into a wellbore;

producing the drilling fluid from the wellbore for removing cuttings from the wellbore, the produced drilling fluid containing combustible gas;

flowing the combustible gas to the ignition source for burning of said combustible gas; and continuously providing an addition fluid at a velocity of at least a minimal flame propagation velocity into the flowing combustible gas downstream of the wellbore and upstream of the ignition source for avoiding flashback from the ignition source.

2. The method as described in claim 1 wherein the continuously providing the addition fluid step further comprises accelerating the flow of combustible gas with the addition fluid for inducing flow of combustible gas to the ignition source.

3. The method as described in claim 2 wherein the accelerating step comprises introducing the addition fluid through a venturi.

4. The method as described in claim 1 wherein the source of the combustible gas is an off-gas from the wellbore, the off-gas being produced at intermittent and unpredictable velocity.

5. The method as described in claim 4 wherein the minimum flame propagation velocity is dependant upon a composition of the off-gas.

6. The method as described in claim 4 wherein the off-gas is a mixture of methane and air and the minimum flame propagation velocity is about 1.5 feet per second.

7. The method as described in claim 1 wherein the providing of the addition gas step comprises adding the addition fluid between a wellhead fluidly connected to the wellbore and the ignition source.

8. The method as described in claim 1 further comprising:

separating the combustible gas from the drilling fluid; and then flowing the combustible gas to the ignition source.

9. The method as described in claim 8 wherein the separating of the combustible gas from the drilling fluid is in a separator; and the providing of the addition fluid step comprises adding the addition fluid between the separator and the ignition source.

10. The method as described in claim 1 wherein the ignition source is a flare.

11. The method as described in claim 1 wherein the addition fluid is air.

12. The method as described in claim 1 wherein the addition fluid is exhaust gas.

13. The method as described in claim 1 wherein the drilling is or has become balanced drilling.

14. The method as described in claim 1 wherein the drilling is or has become underbalanced drilling.

15. The method as described in claim 1 wherein the drilling is selected from the group consisting of air drilling, mist drilling, foam drilling, non-compressible fluid drilling, aerated mud drilling or mud drilling.

16. The method as described in claim 1 wherein the continuously providing the addition fluid step further comprises combining the flow of combustible gas with the addition fluid for inducing flow of combustible gas to the ignition source.

17. The method as described in claim 16 wherein the combining step comprises introducing the addition fluid through a venturi.

18. A system for the prevention of flashback from an ignition source connected to a wellbore producing unpredictable and intermittent flows of combustible hydrocarbons during drilling of the wellbore, the system comprising:

a source of addition fluid connected to the flow of combustible hydrocarbons between the wellbore and the ignition source;

a venturi for accelerating the flow of combustible gas with the addition fluid for inducing flow of combustible gas to the ignition source; and wherein the addition fluid is continuously provided to the flow of combustible hydrocarbons from a wellbore being drilled using a drilling fluid injected into and produced from the wellbore for removing cuttings therefrom, the addition fluid being added in a velocity in excess of a minimal flame propagation velocity to prevent backflash from the ignition source to the wellbore.

19. The system as described in claim 18 wherein the drilling is or has become underbalanced.

20. The system as described in claim 18 wherein the drilling is or has become balanced.

21. The system as described in claim 18 wherein the drilling is selected from the group consisting of air drilling, mist drilling, foam drilling, non-compressible fluid drilling, aerated mud drilling or mud drilling.

22. The system as described in claim 18 further comprising:

a separator positioned downstream from the wellbore and upstream from the addition fluid for separating the combustible hydrocarbons from the drilling fluid and produced cuttings; and a gas outlet for flowing the combustible hydrocarbons from the separator to the ignition source.

23. The system as described in claim 22 wherein the separator is a vertical separator comprising:

an enclosed tubular body having an inlet for accepting the produced drilling fluid comprising liquids, combustible hydrocarbons and cuttings from the wellbore, the tubular body providing a headspace for evolving gases therefrom;

a conical bottom permitting gravity separation of the cuttings from the liquids and gases, the conical bottom having a solids outlet for directing solids to a shale shaker;

a gas outlet at a top end for directing the evolved gases to the ignition source; and a liquid outlet formed in a sidewall of the tubular body for removing a portion of the liquids therefrom, wherein the addition gas is provided to the flow of gas downstream from the separator's gas outlet and upstream from the ignition source for preventing backflash from the ignition source to the separator.

24. The system as described in claim 23 wherein the conical bottom is angled at about 33 degrees or greater.

25. The system as described in claim 22 further comprising:

a vacuum degasser connected to the liquid outlet for receiving and further degassing liquids removed from the separator, the removed gas being directed from the vacuum degasser to the ignition source, wherein the addition gas is provided to the flow of gas downstream from the vacuum degasser and upstream from the ignition source for preventing backflash from the ignition source.

26. The system as described in claim 18 wherein the addition fluid is air.

27. The system as described in claim 18 wherein the addition fluid is exhaust gas.

* * * * *